US006741632B1

(12) United States Patent
Dunn et al.

(10) Patent No.: US 6,741,632 B1
(45) Date of Patent: May 25, 2004

(54) ULTRA HIGH TEMPERATURE RAPID CYCLE INDUCTION FURNACE

(76) Inventors: Michael P. Dunn, 9306 Pine Breeze La., Clarence Center, NY (US) 14032; Michael L. Dunn, 2564 Beebe Rd., Wilson, NY (US) 14172

( * ) Notice: Subject to any disclaimer, the term of this patent is extended or adjusted under 35 U.S.C. 154(b) by 0 days.

(21) Appl. No.: 10/463,985

(22) Filed: Jun. 18, 2003

(51) Int. Cl.[7] ..... H05B 6/22
(52) U.S. Cl. ..... 373/157; 373/138
(58) Field of Search ..... 373/5, 6, 7, 138, 373/139, 140, 144, 147, 148, 151, 155, 156, 157, 159; 75/10.17; 219/628, 634; 422/146; 423/349; 427/213

(56) References Cited

U.S. PATENT DOCUMENTS 3,918,956 A * 11/1975 Baum ..... 75/10.17
5,260,538 A * 11/1993 Clary et al. ..... 219/628
5,502,743 A * 3/1996 Conochie et al. ..... 373/151
5,636,241 A * 6/1997 Yamada et al. ..... 373/156

* cited by examiner

*Primary Examiner*—Tu Ba Hoang
(74) *Attorney, Agent, or Firm*—Michael L. Dunn

(57) ABSTRACT

An induction furnace that has a plurality of high temperature electrically conductive ceramic electrodes having no connecting electrical lead (leadless electrode). The leadless electrodes are exterior to and proximate a working furnace space. At least one metallic electrical conductor surrounds but is not connected to the ceramic electrodes and a power supply is connected to the at least one electrical conductor so that activation of the power supply creates an alternating current through the electrical conductor of sufficient energy to create an electromagnetic flux of sufficient flux density to heat the at least one ceramic electrode to a temperature in excess of about 1700° C. to heat the space. A very high temperature furnace for operation in air is included within the invention wherein electrodes proximate the working furnace space are made of a high temperature, stable, electrically conductive metal oxide and at least one intermediate leadless electrode is provided sufficiently near the proximate metal oxide (e.g. zirconia) ceramic electrodes to heat the proximate metal oxide ceramic electrodes above their electrical conducting temperature so that they conducts sufficient current to maintain their own temperature. The intermediate ceramic electrodes can then be withdrawn. The invention further includes the method of heating a material to high temperature using the furnace of the invention.

20 Claims, 5 Drawing Sheets

ULTRA HIGH TEMPERATURE RAPID CYCLE INDUCTION FURNACE

BACKGROUND OF THE INVENTION

This invention relates to high temperature furnaces, i.e. furnaces operating at temperatures in excess of about 1300° C. and preferably in excess of about 1700° C. (about 3,100° F.) in air and inert atmospheres. At 1700° C. numerous semi-high temperature metals, i.e. those that melt without decomposition or reaction at between 1000° C. and 1700° C. in an inert atmosphere, can be processed. Examples of such semi-high temperature metals include beryllium, copper, cobalt, gadolinium, gold, neodymium, palladium, uranium, iron, manganese, nickel, silicon, titanium, and yttrium. Further, at temperatures up to 1700° C. certain relatively low temperature glass and ceramic materials such as manganese oxide, aluminum metasilicate, silicon dioxide (quartz) and sodium aluminum silicate can be processed.

The invention more particularly relates to such ultra-high temperature furnaces that are low cost, reliable and that require relatively low maintenance.

Major problems exist with current high temperature furnaces that are usually electrical type furnaces using electric arcs, which are unstable, difficult to control, and unpredictable or electric resistance furnaces which are deficient in that at high enough temperatures rapid disintegration of the electrode or disintegration of electrical contacts occurs due to oxidation or thermal shock associated with non-uniform heating and cooling. Even assuming such problems did not exist, such furnaces are not available that can reliably and controllably operate at ultra high temperatures, e.g. in excess of 3000° C.

BRIEF DESCRIPTION OF THE INVENTION

In accordance with the invention, an induction furnace is provided that has a plurality of high temperature electrically conductive ceramic electrodes having no connecting electrical lead (leadless electrodes). The leadless electrodes are exterior to and proximate a working furnace space. At least one metallic electrical conductor surrounds but is not connected to the ceramic electrodes and a power supply is connected to the at least one electrical conductor so that activation of the power supply creates an alternating current through the electrical conductor having a frequency of between $10^2$ and $10^{11}$ cycles per second and of sufficient energy to create an electromagnetic flux having a wave length of between about $10^{-1}$ and about $10^8$ cm of sufficient flux density to heat the ceramic electrodes to a temperature in excess of about 1300° C. and preferably above about 1700° C. to heat the space. In general a plurality of electrodes collectively surround the furnace space, e.g. in the form of a plurality of spaced parallel rods. When the material being heated within the furnace is air sensitive or the temperature is so high that the electrodes will be affected by surrounding air, the electrodes and contents are surrounded by an inert atmosphere selected from a vacuum, nitrogen, the noble gases or mixtures thereof. In such a case, temperatures in excess of 2000° C. may be reached.

A very high temperature furnace for operation in air is included within the invention wherein the electrodes proximate the working furnace space are made of a high temperature, stable, electrically conductive metal oxide. A preferred metal oxide for that purpose is a metal oxide that is conductive at high temperatures, e.g. zirconia. In such a case, at least one intermediate leadless electrode is provided sufficiently near the proximate metal oxide (e.g. zirconia) ceramic electrode to heat the proximate metal oxide ceramic electrodes above their electrical conducting temperature, i.e. the temperature at which the oxide becomes sufficiently electrically conductive so that it conducts sufficient current to maintain its own temperature, usually above about 1000° C. The intermediate electrode is conductive at low temperatures, e.g. at room temperature, and may be ceramic, e.g. silicon carbide or a high temperature metal, e.g. platinum. The intermediate electrode is heated by the flux to a temperature above the electrical conducting temperature of the proximate oxide electrode and is withdrawn from the flux when the proximate oxide electrodes become electrically conductive so as to maintain its own temperature above its conductive temperature within the flux. Since the proximate electrodes, e.g. zirconia, are already an oxide, this permits the zirconia electrodes to act as the heating electrodes to an ultra high temperature in air. In such a furnace a zirconia electrode may be heated to above 2200° C. by the flux thus similarly heating the furnace space. In a preferred embodiment, the proximate electrodes are essentially made of zirconia and a plurality of intermediate leadless ceramic electrodes are either provided between the proximate ceramic electrode and the electrical conductor or between the proximate ceramic electrodes. The intermediate ceramic electrodes can then be heated by the flux to a temperature above the electrical conducting temperature of the zirconia, i.e. to about 1200° C., and can then be withdrawn.

The invention further includes the method of heating a material to high temperature using the furnace of the invention.

DETAILED DESCRIPTION OF THE INVENTION

Figure 1:
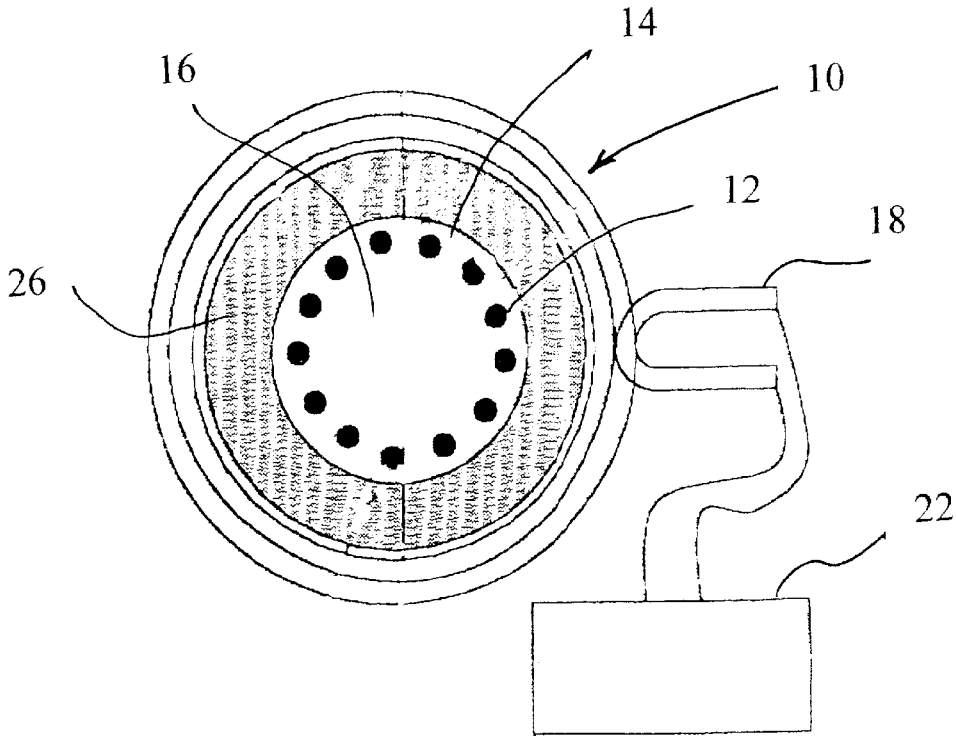
FIG. 1 shows a top cross sectional view of a preferred embodiment of a furnace of the invention using a ring of leadless conductive ceramic rods as the electrode used for the heating element.

At the heart of the present invention is the discovery that electrically conductive high temperature ceramics could be used as electrodes for heating elements in furnaces without being electrically connected to a power source. In particular, the electrodes are heated by induction from a high energy electromagnetic flux. This avoids problems associated with thermal shock and temperature gradients in traditional resistance type furnaces and electrical arcs. In addition, instability of electrical arcs is avoided and the heating elements are capable of surrounding the furnace area which is not usually reasonably practical with arcs since a plurality of arcs in close proximity tend to interact thus even further reducing uniformity and control.

As a result of the present discovery, furnace chambers surrounded by an electrical heating source are now possible that reliably and stably operate at elevated temperatures never before practical in air (up to about 2700° C.) and at elevated temperatures never before practical in an inert environment (up to about 3800° C.).

Within such temperature ranges, most high temperature metals and most high temperature ceramic materials can be processed. Such high temperature materials for example include most high temperature materials having a melting point at atmospheric pressure and further permits the formation of many high temperature vapors. Materials that can be melt processed in the furnace of the invention, for example include, aluminum oxide, aluminum silicate, barium nitride, barium oxide, beryllium, boron, chromium, chromium oxide, nickel-chromium alloy, hafnium, hafnium oxide, iridium, lanthanum hexaboride, lanthanum oxide, magnesium oxide, magnesium orthosilicate, molybdenum, molybdenum carbide, niobium, niobium nitride, niobium trioxide, osmium, platinum, rhenium, rhodium, ruthenium, tantalum oxide, thorium hexaboride, titanium dioxide, vanadium, vanadium nitride, vanadium sequioxide, yttrium oxide, zirconium dioxide and zirconium. About the only materials that cannot be melt processed are hafnium carbide, and tantalum carbide that melt at about 3,890 and 3,880° C. respectively. Materials that can be vapor processed for example include essentially all natural metals excepting the periods 5 and 6 transition metals of zirconium, rhodium, molybdenum, hafnium, tantalum, tungsten, rhenium, osmium and platinum; almost all high temperature stable oxides excepting certain transition metal oxides, i.e. lanthanum oxide, hafnium oxide, and zirconium dioxide; and essentially all reasonably available high temperature stable carbides excepting hafnium carbide, tantalum carbide, tungsten carbide, vanadium carbide and zirconium carbide.

The invention includes the method of using the furnaces of the invention to permit novel processing of certain materials that were previously difficult, impractical, or impossible to melt or vapor process. For example, furnaces can be built and used that permit vaporization of high temperature metals for distillation and for centrifugal separation of isotopes. The furnaces can be used for casting, extrusion and spinning of melts of ultra-high temperature materials. The furnaces can be used for preparation of vapors of ultra-high temperature and other materials for vapor deposition, film formation and crystal development. The furnaces can be used to prepare liquid melts of ultra-high temperature materials for crystal drawing. The furnaces can be used for heat formation of ionic materials for electrical and electromagnetic processing, ionic acceleration or containment. The furnaces can be used for high temperature chemical reactions, e.g. the formation of metal carbides from a compacted mixture of metal powder and graphite, the formation of tantalum carbide from tantalum powder and graphite, the formation of hafnium carbide from hafnium powder and graphite, the formation of zirconium carbide from zirconium powder and graphite, or the formation of tungsten carbide from tungsten powder and graphite in an inert atmosphere such as argon. The furnaces can also be used for forming alloys of high temperature metals and other materials, in the absence of an arc, by melting mixtures of such metals.

In accordance with the invention, ceramic electrodes, for use as electrodes proximate the furnace space as heating elements for the space, that are self starting, i.e. do not require preheating from room temperature, are usually made of high temperature stable metal or transition metal carbides, especially silicon carbide, zirconium carbide, tantalum carbide, hafnium carbide and niobium carbide. A relatively inexpensive material for making such an electrode operating at about 1300° C. is siliconized silicon carbide, e.g. at about 20 weight percent silicon and about 80 weight percent silicon carbide. A material suitable for use in air up to about 1700° C. and in an inert atmosphere to about 1800° C. is molybdenum disilicide. Ceramic electrodes for use as proximate electrodes that require starting, i.e. preheating before becoming sufficiently electrically conductive include certain refractory metal oxides, e.g. zirconium oxide.

The power supply for furnaces of the invention usually provides an alternating current at a frequency of between $1\times10^4$ and $1\times10^{10}$ cycles per second. The power required depends upon the conductivity of the elements, the size of the furnace and the temperature desired. The power can readily be determined by those skilled in the art either by back calculating required heat output to needed input wattage using the well known formula $P=EI\cos\phi$ where P is the power in watts (joules per second), E is the effective input EMF in volts, I is the effective input current in amperes and $\phi$ is the phase angle between the current and imposed EMF. From Ohms law, E=IR where I is the effective amperage input, as previously discussed, and R is the resistance of the elements, heat output in calories per second may then be calculated as C=W/4.186. Required heat output is directly proportional to the temperature desired, the specific heat of the furnace components and contents, and the loss of heat from the furnace in conductive and radiant heat transfer. Optionally, the energy input can be determined by simple experiment by increasing wattage input until the desired temperature is obtained. The size of the metallic electrical conductor must be chosen so as to be capable of sufficient power output without overheating. An advantage of the present invention is that the conductor is not the heating element and thus need not reach the temperature of the heating element and can thus be designed to carry very large current loads, the energy of which is transferred to the heating elements or elements by inductance. For a furnace of relatively small dimension, e.g. a silicon carbide heating element formed of a ring of 27, ⅝ inch outside diameter by 12 inches long silicon carbide tubes at a ring diameter of about fifteen centimeters, using a helical conductor about twenty-five centimeters inside diameter, with intermediate high temperature insulation, a radio frequency output of about 10 to about 15 amperes at a frequency of about 300 kHz will create a furnace temperature of about 2000° C. as determined by a white hot radiance.

A preferred output frequency for use in accordance with the invention is from about 100 to about 450 Khertz (cycles per second). At temperatures above the oxidation temperature of the electrodes or material being processed in the furnace, an inert atmosphere is required. Preferred inert atmospheres are the noble gases or vacuum.

The metallic conductor is preferably made of copper in the form of a copper tube of relatively large dimension in the form of one or more coils around the heating element(s) capable of carrying large current loads, e.g. having an outside tube dimension of from about ⅜ inch to about two inches to carry current loads of from about 5 to about 50 amperes.

The invention may be better understood by reference to the drawings that illustrate examples of preferred embodiments of the invention.

Figure 2:
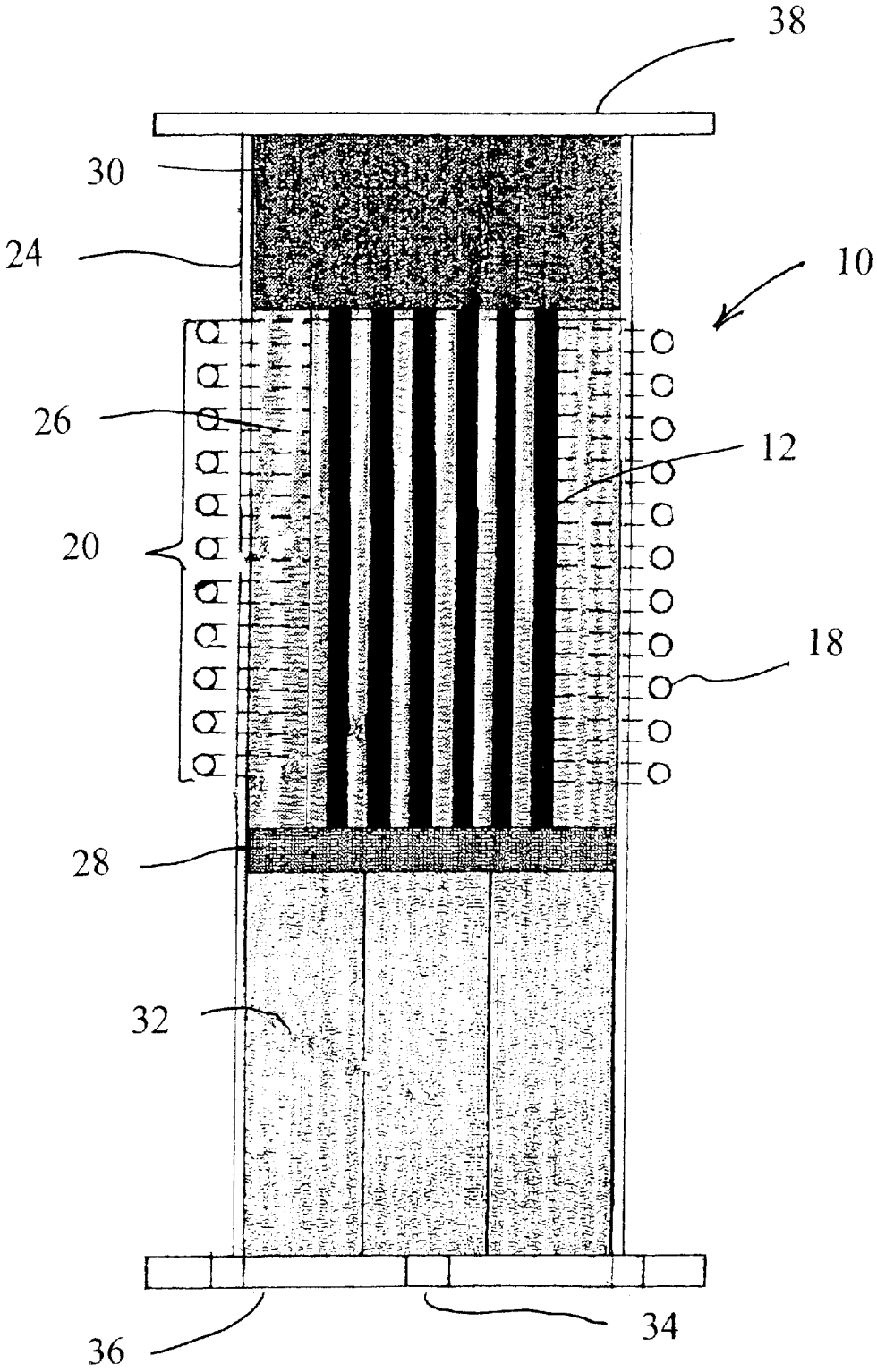
FIG. 2 shows a cross sectional elevational view of the furnace of FIG. 1.

As best seen in FIGS. 1 and 2, in a preferred embodiment of the invention, an induction furnace 10 is provided with a series of electrically conductive leadless ceramic electrodes 12 which may for example be silicon carbide rods arranged in a 6 inch outside diameter ring 14. The ceramic electrodes 12 surround and are proximate an operating furnace space 16. The ceramic electrodes 12 are surrounded by a metallic electrical conductor 18 that forms an induction coil 20 connected to an alternating current power supply 22. In a preferred embodiment, the induction coil surrounds a non-electrically conductive furnace shell 24, e.g. in the form of a quartz tube. The space between the furnace shell and the electrodes is preferably filled with an insulating material 26, e.g. in the form of an alumina or zirconia fiber blanket. The furnace space 16 has a bottom closure 28 and a top closure 30 that may be made of a high temperature ceramic material.

The furnace space bottom closure 28 preferably rests upon a fire brick base 32 that in turn rests upon a furnace base 36 that may be provided with an inlet 34, for providing a vacuum or an inert gas into the furnace. The top of the furnace 10 is provided with a top cover 38 for completing a furnace enclosure. The furnace base 34 and cover 38 are of a high temperature, non-electrically conductive material such as quartz or alumina.

Figure 3:
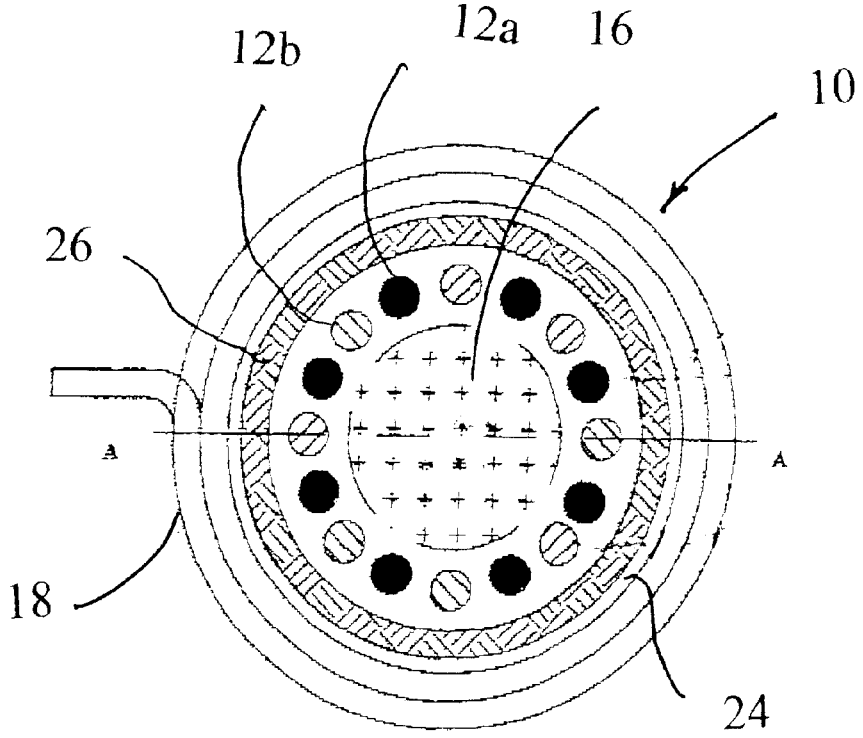
FIG. 3 shows a top cross sectional view of a preferred embodiment of a furnace of the invention having both heating electrodes and intermediate electrodes.
Figure 4:
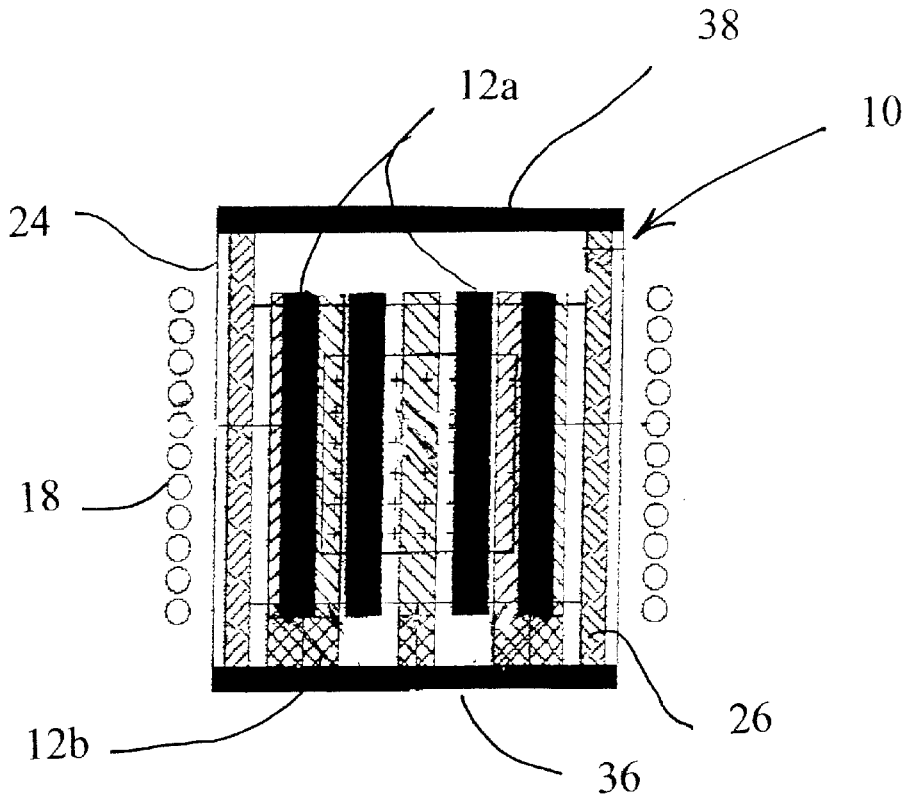
FIG. 4 shows an elevational cross section of the furnace of FIG. 3.
Figure 5:
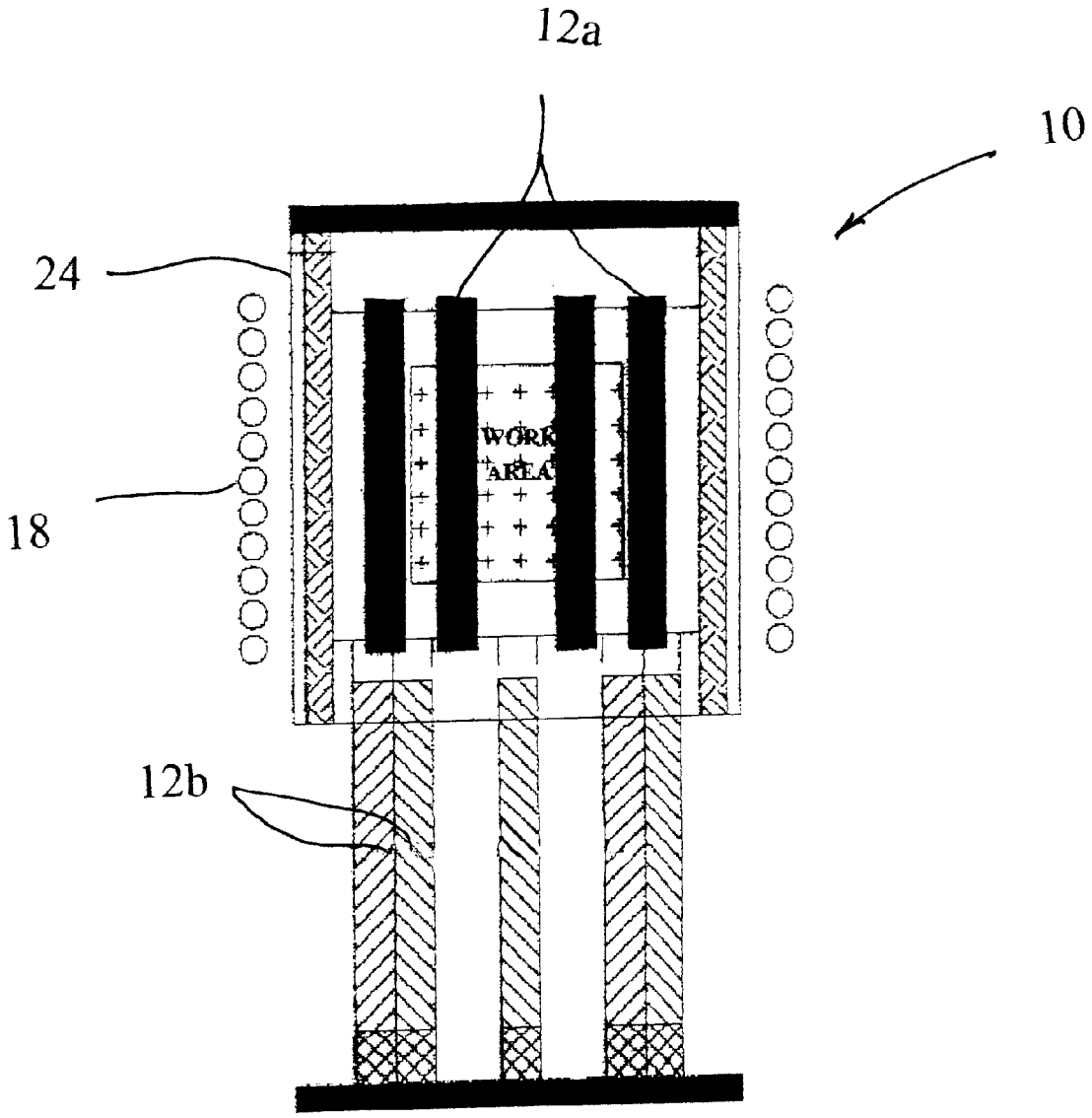
FIG. 5 shows an elevational cross section of the furnace of FIG. 3 where the intermediate electrodes have been withdrawn.

An alternative embodiment of the invention is shown in FIGS. 3 through 5 having essentially the same components as the embodiment of FIGS. 1 and 2 where the ceramic electrodes are of two types, i.e. a type 12*a* that is a very high temperature electrode that is only conductive at elevated temperature and a type 12*b* that is an intermediate electrode that is conductive at a lower temperature. The base of the furnace is moveable so that the intermediate electrodes 12*b* can be removed from the vicinity of the high temperature electrodes 12*a* after the high temperature electrodes 12*a* reach conducting temperature due to heating by the intermediate electrodes that are conductive at room temperature.

What is claimed is:

1. An induction furnace comprising a plurality of high temperature electrically conductive leadless heating ceramic electrodes exterior to and proximate a working furnace space, at least one metallic electrical conductor surrounding the ceramic electrodes and a power supply connected to the at least one electrical conductor so that activation of the power supply creates an alternating current through the electrical conductor having a frequency of between $10^{11}$ and $10^{2}$ cycles per second and of sufficient energy to create an electromagnetic flux having a wave length of between about $10^{-1}$ and about $10^{8}$ cm of sufficient flux density to heat the proximate ceramic electrodes to a temperature in excess of about 1000° C. to heat the furnace space.

2. The induction furnace of claim 1 wherein the electrodes are arranged in a ring to surround the furnace space.

3. The induction furnace of claim 1 wherein the electrodes are surrounded by an inert atmosphere selected from vacuum, nitrogen, the noble gases and mixtures thereof and the temperature is in excess of 2000° C.

4. The induction furnace of claim 2 wherein the heating electrodes consist essentially of a high temperature ceramic that is conductive at elevated temperature and at least one intermediate leadless ceramic electrode, surrounded by the electrical conductor, is provided near the proximate ceramic electrode, said intermediate ceramic electrode being heated by the flux to a temperature above the electrical conducting temperature of the high temperature ceramic electrode and being arranged to be withdrawn from the flux when the intermediate ceramic electrode becomes electrically conductive so as to maintain its own temperature above its conductive temperature within the flux.

5. The induction furnace of claim 4 wherein the ceramic electrodes is heated to above 2200° C. by the flux thus similarly heating the furnace space.

6. The induction furnace of claim 4 wherein a plurality of proximate heating ceramic electrodes are provided that consist essentially of zirconia and a plurality of intermediate leadless ceramic electrodes surrounded by the electrical conductor, are provided near the proximate ceramic electrodes, said intermediate ceramic electrodes being heated by the flux to a temperature above the electrical conducting temperature of the zirconia electrodes and being withdrawn from the flux when the zirconia electrodes become electrically conductive so as to maintain their own temperature above their conductive temperature within the flux.

7. The induction furnace of claim 6 wherein the zirconia electrodes are heated to above 2200° C. by the flux thus similarly heating the furnace space.

8. The induction furnace of claim 1 wherein the power supply provides an alternating current at a frequency of between $1\times10^{4}$ and $1\times10^{10}$ cycles per second.

9. The furnace of claim 6 where the intermediate ceramic electrodes are silicon carbide electrodes.

10. The furnace of claim 1 where the heating electrodes are made of silicon carbide.

11. The furnace of claim 1 where the heating electrodes are made of a material selected from the group consisting of molybdenum disilicide, siliconized silicon carbide, silicon carbide, zirconia, zirconium carbide, and tantalum carbide.

12. The method for heating a material to ultra high temperature which comprises placing the material into the furnace of claim 1 and activating the power supply to heat the material.

13. The method for heating a material to ultra high temperature which comprises placing the material into the furnace of claim 2 and activating the power supply to heat the material.

14. The method for heating a material to ultra high temperature which comprises placing the material into the furnace of claim 3 and activating the power supply to heat the material.

15. The method for heating a material to ultra high temperature which comprises placing the material into the furnace of claim 4 and activating the power supply to heat the material.

16. The method for heating a material to ultra high temperature which comprises placing the material into the furnace of claim 5 and activating the power supply to heat the material.

17. The method for heating a material to ultra high temperature which comprises placing the material into the furnace of claim 6 and activating the power supply to heat the material.

18. The method for heating a material to ultra high temperature which comprises placing the material into the furnace of claim 8 and activating the power supply to heat the material.

19. The method for heating a material to ultra high temperature which comprises placing the material into the furnace of claim 9 and activating the power supply to heat the material.

20. The method for heating a material to ultra high temperature which comprises placing the material into the furnace of claim 10 and activating the power supply to heat the material.

* * * * *